US005395271A

United States Patent [19]

Tyler

[11] Patent Number: 5,395,271

[45] Date of Patent: Mar. 7, 1995

[54] STORAGE APPARATUS AND METHOD FOR PROP WRENCH AND NUT

[75] Inventor: William C. Tyler, Columbus, Miss.

[73] Assignee: Brunswick Corporation

[21] Appl. No.: 72,247

[22] Filed: Jun. 4, 1993

[51] Int. Cl.[6] ..... B60L 11/02

[52] U.S. Cl. ..... 440/6; 440/900

[58] Field of Search ..... 248/640-642; 206/349, 372, 373-378; 114/343, 364, 363; 440/6, 7, 900, 53; D12/317

[56] References Cited

U.S. PATENT DOCUMENTS

| | | | |
|---|---|---|---|
| 3,665,534 | 5/1972 | McIntyre | 114/343 |
| 3,674,228 | 7/1972 | Horton | 248/640 |
| 4,129,088 | 12/1978 | Foley, Jr. | 248/640 |
| 4,372,243 | 2/1983 | Roope, Jr. | 114/364 |
| 4,734,068 | 3/1988 | Edwards | 440/56 |
| 4,909,176 | 3/1990 | Kobayashi | 114/343 |
| 5,029,706 | 1/1991 | McCraken | 206/349 |
| 5,137,481 | 8/1992 | Wengler | 440/77 |

FOREIGN PATENT DOCUMENTS

| | | | |
|---|---|---|---|
| 2554410 | 5/1985 | France | 114/364 |

OTHER PUBLICATIONS

1993 Motorguide catalog.

*Primary Examiner*—Edwin L. Swinehart

*Attorney, Agent, or Firm*—Rosenblatt & Associates

[57] ABSTRACT

The arrangement and receptacle storing the prop wrench and spare prop nut allow the fisherman to store the necessary tools to quickly replace a prop on a trolling motor on the spot. The prop wrench has three principal components—the prop wrench base, the prop pins, and the prop wrench cap. The prop wrench base has storage compartments to store the spare prop pins, which are secured in place by the prop wrench cap. Both the prop wrench and the spare prop nut are stored in the housing. The housing has preformed molded recesses which correspond, respectively, to the shape of the prop wrench and the prop nut. The spare prop nut and the prop wrench are locked into place within the housing by a lip on the prop wrench base that snaps into a locking relationship with the snap fit on the housing, and is further secured by two tabs located opposite the snap fit within the recess and above the prop wrench assembly. The housing performs its normal function of support for the trolling motor while also providing a handy location to store the equipment described.

17 Claims, 2 Drawing Sheets

STORAGE APPARATUS AND METHOD FOR PROP WRENCH AND NUT

FIELD OF THE INVENTION

The field of this invention relates generally to storage of fishing tools, more particularly, to the arrangement for storage of a prop wrench and spare prop nut on the deck of a boat.

BACKGROUND OF THE INVENTION

Storage space in a fishing boat is sparse and when repairs are necessary, quick access to the tools is essential. In the past, tools have been stored in various locales in the boat. This entailed use of valuable space, and sometimes it becomes difficult to locate the tools. Storage bags can be easily soaked by salt or fresh water, which deteriorates the tools and renders them useless.

U.S. Pat. No. 5,029,706 illustrates a wrench storage arrangement within a router-housing mechanism. The top of the router housing is constructed to form apertures conforming to the shape of the wrench handle. A pair of beams forming longitudinal ribs that lie perpendicular to the apertures are molded into the top of the housing. Notches are provided on both side surfaces of the wrench handle. The wrench handle is secured in the router housing by extending the wrench handle through one of the apertures. The handle extends into the cavity and downwardly deflects the flexible beams. The wrench handle continues to extend out of the other aperture. The notches then align with the ribs and engage the wrench in a detent manner so that the wrench is releasably retained in a stored position within the housing. Although the apertures in this invention are designed to fit the shape of the wrench handle, interaction of the wrench handle, ribs, notches, and both apertures is required to secure the tool in the router housing.

U.S. Pat. No. 5,137,481 provides a pocket on a outboard motor tote for tools. However, this tote with the tool pocket is removed when the motor is in operation. The tool storage on this invention entails a limited-space pocket that is covered only by a flap and secured by a mechanical fastener. Space is limited and access is difficult because the tote must be stored while the boat is in use.

U.S. Pat. No. 4,372,243 is a netted framed mechanism that is suspended from the stern of the boat while the fisherman repairs the motor. The function of this invention is to prevent loss of tools, not to store tools on a permanent basis.

The present invention provides a space-saving housing arrangement in the decket for a prop wrench, prop pins, and spare prop nut. The fisherman can easily make a repair using these spares without having to come to shore. The decket is part of a deck-mounted structure that is used in positioning a trolling motor unit on a boat deck prior to stowing and during use. This is advantageous to the fisherman because access to the tool is easy and the fisherman always knows where the tools are. The storage arrangement does not interfere with the mechanical function of the housing. The prop pins are isolated from the weather inside the prop wrench. The prop nut is similarly isolated by the prop wrench.

SUMMARY OF THE INVENTION

The present invention allows the fisherman to store the necessary tools to quickly replace the prop on the trolling motor on the spot. The prop wrench assembly has three principal components, the prop wrench base, prop pins, and prop wrench cap. The prop wrench base provides storage for two prop pins, which are secured in place by the prop wrench cap. Both the prop wrench assembly and the spare prop nut are stored in the housing. The housing has preformed recesses which correspond, respectively, to the shape of the prop wrench assembly and the prop nut. The prop nut and the prop wrench assembly are locked into place within the housing by a lip on the prop wrench assembly that snaps into a locking relationship with the snap fit located above the recess.

DETAILED DESCRIPTION OF THE PREFERRED EMBODIMENT

Figure 1:
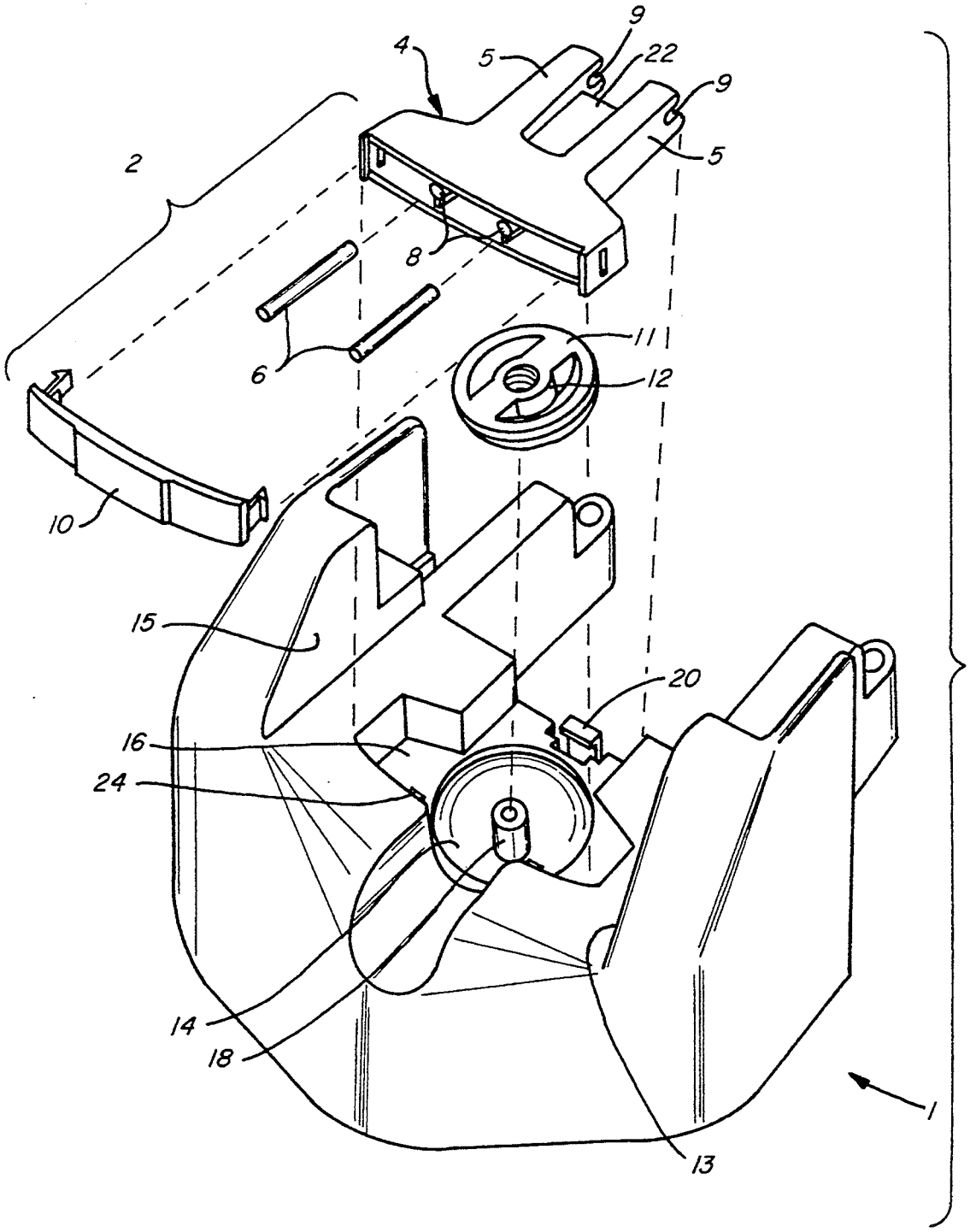
FIG. 1 is an exploded isometric view of the present invention.
Figure 2:
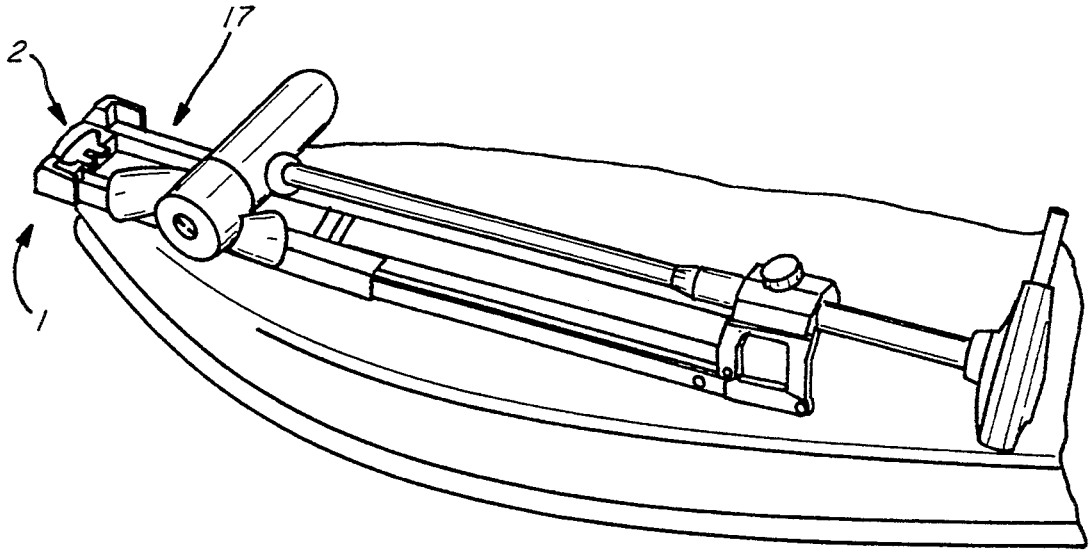
FIG. 2 is an isometric view showing the housing as mounted on a boat deck as part of a trolling motor assembly.

The apparatus is shown in FIG. 1. The present invention is stored in a recessed area on the upper surface of the housing 1, which functions to correctly position the trolling motor unit, as shown in FIG. 2. The apparatus is made of three principal components—the prop wrench assembly 2, recesses 14 and 16 in the housing 1, and the locking mechanisms 20, 22, and 24 that secure the tools inside recesses 14 and 16.

Prop wrench assembly 2 contains the prop wrench base 4, two spare prop pins 6, two storage compartments 8 for storing the spare prop pins 6, and a prop wrench cap 10 that secures spare prop pins 6 into the two storage compartments 8. Prop wrench base 4, used to tighten spare prop nut 12 to a desired torque, is a handle with two extensions 5 separated by the prop wrench lip 22. Indentations 9 on the tips of the extensions 5 are shaped to grip a prop nut 12 of a particular design.

Prop pins 6, tubular in shape, can be used to key the prop to the armature shaft to prevent the prop from freely rotating. Two elongated storage compartments 8 corresponding in size to prop pins 6 are located on the top surface of prop wrench base 4. Prop wrench cap 10 locks into the top surface of prop wrench base 4 to secure stored prop pins 6 into elongated storage compartments 8.

Two corresponding recesses, respective in size and shape to prop wrench assembly 2 and spare prop nut 12, are preformed and molded into the top surface of housing 1. Spare prop nut 12 is secured in place within recess 14 by a mandrel 18. Prop wrench assembly 2 fits into recess 16 and is stored on top of spare prop nut 12. Lip 22 on prop wrench base 4 snaps into snap fit 20. Preferably, two tabs located within recess 16 on the top surface of housing 1, opposite snap fit 20 and above prop wrench assembly 2, releasably retain prop wrench assembly 2 and spare prop nut 12 in place.

Figure 3:
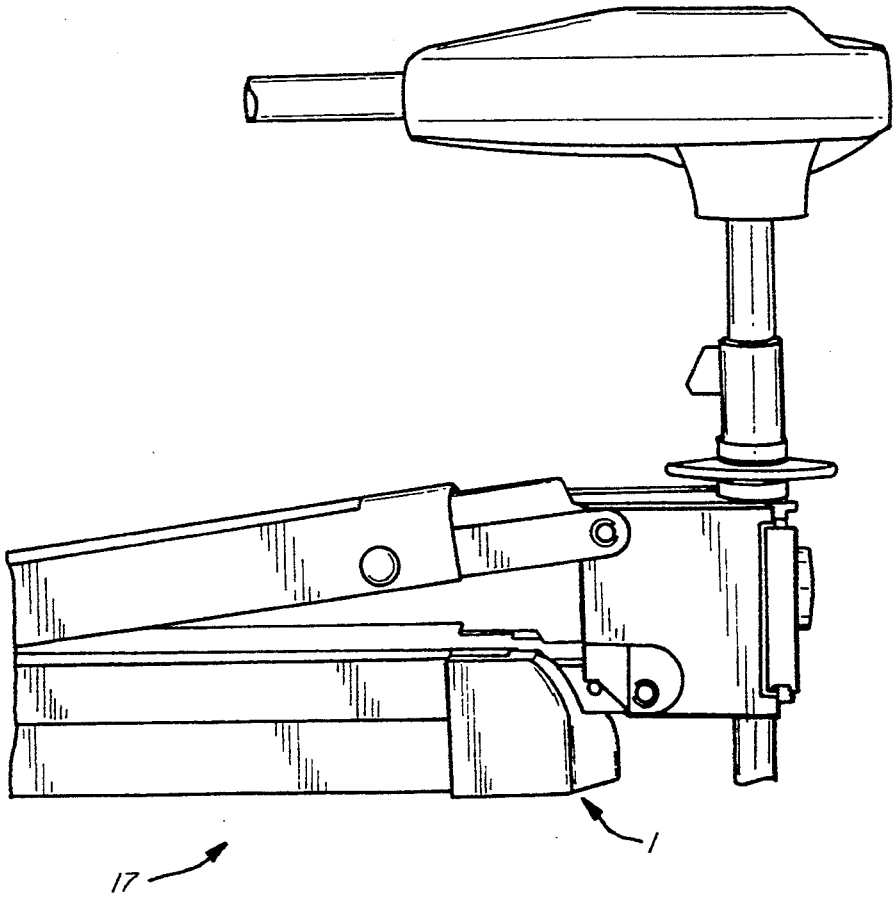
FIG. 3 is an elevational view showing a trolling motor support assembly resting on the housing with the spare prop nut, prop pins, and prop wrench stored therein.

Housing 1 has a pair of wing walls 13 and 15 between which a support mechanism 17 (see FIG. 3) can be set to perform the housing's ordinary function, even while the spare nut 12 and wrench assembly 2 are in recesses 14 and 16.

The foregoing disclosure and description of the invention are illustrative and explanatory thereof, and various changes in the size, shape, and materials, as well as in the details of the illustrated construction, may be made without departing from the spirit of the invention.

I claim:

1. In combination, a housing for storage and a prop nut and wrench for a boat trolling motor, said housing supporting a boat trolling motor when in use, comprising:

a housing mounted to a boat, said housing having a recess;

a securing member on said housing;

a prop nut, said recess adapted to accept said nut so as to place said nut within said housing;

a prop wrench, said recess adapted to accept said wrench so as to place said wrench at least in part in said recess; and said securing member securing said prop nut and said prop wrench to said housing.

2. The combination of claim 1, wherein:

said nut is shielded from exposure to the elements when secured in said recess in said housing and stacked below said wrench.

3. The combination of claim 2, wherein said recess further comprises:

a first cavity shaped to conform to the periphery of said nut; and a second cavity adjacent said first cavity shaped to conform to at least a portion of the periphery of said wrench.

4. The combination of claim 3, wherein:

said securing member is disposed at least in portion said second cavity for holding said prop wrench in said second cavity.

5. The combination of claim 4, further comprising:

a mandrel in said first cavity for accepting said prop nut therein for aiding in insertion and alignment of said nut in said first cavity.

6. The combination of claim 5, wherein:

said prop wrench further comprises:

a base;

an engagement surface on said base; and said securing member comprising a flexible snap to engage said engagement surface for selectively securing said wrench in said second cavity.

7. The combination of claim 6, wherein:

said housing having a guiding member for a troll motor when the troll motor is in its stowed position;

said guiding member disposed further from the boat on said housing than said first and second cavities; and said first and second cavities disposed contiguously in said housing.

8. The combination of claim 7, wherein:

said prop wrench having at least one compartment therein;

at least one prop pin, said pin adapted for storage in said compartment;

a cover mounted to said prop wrench to secure said pin in said compartment; and said second cavity formed to accept said cover mounted to said prop wrench for storage thereof to said housing.

9. A method for storing spare boat components in a boat having a trolling motor, comprising:

mounting a housing to the boat which includes a pivoting linkage to support a trolling motor in two positions;

providing a storage compartment in said housing;

providing at least one extending member from said housing adjacent to said compartment;

inserting the spare components at least in part into said storage compartment;

securing the components to said housing; and using said extending member to support the trolling motor adjacent said compartment when the trolling motor is in use and the components stored in said compartment.

10. The method of claim 9, wherein:

said inserting step further comprises placing a trolling motor prop nut into said compartment;

overlaying a prop wrench on the prop nut; and said securing step further comprises using a housing-mounted snap to secure the prop wrench to said housing.

11. The method of claim 10, further comprising the steps of:

providing at least one storage area in said prop wrench;

storing at least one prop in said area; and securing the prop pin in said area.

12. The method of claim 11, further comprising the steps of:

shielding the prop nut from weather exposure by virtue of said overlaying of the prop wrench in said compartment; and shielding the prop pin from weather exposure by a cover applied over said storage area.

13. The method of claim 12, further comprising the step of:

providing a relief in said housing higher in said housing than said compartment;

shaping the compartment on different levels to the shape of the prop nut and prop wrench; and leaving the relief in the housing exposed for support of a stowed motor unit after securing the prop nut and prop wrench to said shaped compartment.

14. The method of claim 13, further comprising the steps of:

using a snap fit to secure the prop wrench to said compartment; and positioning the prop wrench flush with the open top of said compartment for securing it with the snap fit.

15. A multipurpose apparatus for a fishing boat having a trolling motor, comprising:

a deck-mounted housing having an upper and lower end and at least one extending member extending from said upper end;

a support structure for the trolling motor movably located adjacent the top end of said housing;

said housing formed having an opening, said opening shaped to accept a prop nut and prop wrench for a trolling motor;

said opening located between said support and said lower end in a manner so as to allow said extending member on said housing to support said structure adjacent said opening when the trolling motor is in use; and a securing member mounted adjacent said opening for securing a prop nut and prop wrench stowed therein.

16. The apparatus of claim 15, wherein:

said opening having a plurality of shapes comprising:

a first shape formed to the shape of a prop nut closest to said lower end of said housing;

a second shape between said first shape and said support formed to the shape of a prop wrench; and said combined shapes being substantially occupied by the prop nut and prop wrench when secured therein without obstruction of the functioning of said support.

17. The apparatus of claim 16, wherein said support further comprises:

a notch formed in said housing adapted to accept a portion of a trolling motor assembly.

* * * * *